US008302230B1

(12) United States Patent
Jarrett, Jr. et al.

(10) Patent No.: US 8,302,230 B1
(45) Date of Patent: Nov. 6, 2012

(54) BEDDING ARTICLE FOR SUPPORTING INFANTS WITH GASTROESOPHAGEAL REFLUX CONDITION HAVING IMPROVED ANTI-TWISTING FEATURES

(76) Inventors: Keith A. Jarrett, Jr., Kenner, LA (US); Terry Barber Jarrett, Kenner, LA (US)

( * ) Notice: Subject to any disclaimer, the term of this patent is extended or adjusted under 35 U.S.C. 154(b) by 189 days.

(21) Appl. No.: 12/474,449

(22) Filed: May 29, 2009

Related U.S. Application Data

(60) Provisional application No. 61/057,081, filed on May 29, 2008.

(51) Int. Cl.
*A47C 16/00* (2006.01)

(52) U.S. Cl. ..... 5/655; 128/875

(58) Field of Classification Search ..... 5/603, 632, 5/633, 652, 655; 128/845, 846, 872, 874–876; 2/69.5
See application file for complete search history.

(56) References Cited

U.S. PATENT DOCUMENTS

| | | | | |
|---|---|---|---|---|
| 4,989,286 | A * | 2/1991 | Tucker | 5/482 |
| 5,439,008 | A * | 8/1995 | Bowman | 128/875 |
| 6,877,176 | B2 * | 4/2005 | Houghteling | 5/655 |
| 2004/0261180 | A1 * | 12/2004 | Birns | 5/655 |

* cited by examiner

*Primary Examiner* — Robert G Santos
*Assistant Examiner* — Nicholas Polito
(74) *Attorney, Agent, or Firm* — Garvey, Smith, Nehrbass & North, L.L.C.; Charles C. Garvey, Jr.; Julia M. FitzPatrick

(57) ABSTRACT

A bedding article for reflux babies and/or other infants or children having a medical condition that requires an inclined sleeping position has anti-rotation features. These features include multiple securements or fasteners between a sling and a base or mattress. These features can include removable blocks (e.g. foam or the like) that are removably attachable to the sling on one or both sides.

19 Claims, 5 Drawing Sheets

BEDDING ARTICLE FOR SUPPORTING INFANTS WITH GASTROESOPHAGEAL REFLUX CONDITION HAVING IMPROVED ANTI-TWISTING FEATURES

CROSS-REFERENCE TO RELATED APPLICATIONS

Priority of U.S. Provisional Patent Application Ser. No. 61/057,081, filed May 29, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to bedding articles for use with infants, wherein the infant has a medical condition that requires inclination or elevation of the torso and head (e.g. gastroesophageal reflux).

2. General Background of the Invention

Small infants that suffer from a condition known as gastroesophageal reflux condition are desirably kept in a crib that has a mattress with an inclined or partially elevated orientation of about thirty degrees (30°). The problem is that if the child is left unattended, it can very easily tumble or slide down the mattress if it begins to move about.

Previously, U.S. Pat. No. 4,989,286 (hereby incorporated herein by reference) provided a bedding article for supporting reflux babies upon an underlying crib mattress in an inclined position. The bedding article of the '286 patent provides a band of bedding material that defines a partial covering for a crib mattress while forming a tensile load carrying connection therewith. The band had a lower end portion position during use at the middle area of the mattress. An infant support sling was connected to the band of bedding material at the lower end portion thereof and included a central panel portion, a left panel portion, and a right panel portion that can be connected to define a diaper that covers the infant's groin and pelvic areas. This support sling provided leg apertures accommodating the infant's legs, the leg apertures being pointed generally away from an upper tensile load carrying connection so that when the mattress is inclined, the diaper supports the infant and the band carried the infant's weight to prevent a sliding of the infant down the mattress during use. The band encircled the mattress with a first closed end adapted to register with an end of the mattress and a second lower end.

Some infants who are larger or stronger have used the device shown and described in the Tucker '286 patent. These larger or stronger infants have in some cases attempted to turn over, twist or otherwise disorient the sling relative to the mattress. The present invention provides an improved bedding article for supporting infants with gastroesophageal reflux condition. The sling disclosed in the Tucker '286 patent would have a tendency to twist if the baby attempted to roll over. The '286 patent lacked cushion attachments and improved buckle arrangement of the present invention.

BRIEF SUMMARY OF THE INVENTION

The present invention provides an improved bedding article for supporting reflux babies. The apparatus employs a base mattress having an inclined upper surface.

An infant support sling includes an upper section defining a whole or partial covering for the mattress and forming a connection therewith. The upper section provides a lower end portion positioned during use at the middle area of the mattress. The lower portion of the sling has a central panel portion, a left panel portion, and a right panel portion. These panel portions connect to form a diaper that covers the infant's groin and pelvic areas. Leg apertures of the diaper accommodate the infant's legs when the diaper is formed. The leg apertures are pointed generally away from the upper section of the sling so that when the mattress is inclined the diaper supports the infant and the upper section carries the infant's weight to prevent a sliding of the infant down the mattress during use.

A plurality of connector strips connect and hold the sling to the mattress. The strips can include at least two strips that are longitudinally spaced apart and at least two strips that are transversely spaced apart. The strips prevent a rolling or lateral displacement of the infant or child by holding the lower part of the sling to the upper surface of the base/mattress.

Optional blocks (e.g. foam) can be employed to further help prevent the child from rolling laterally.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
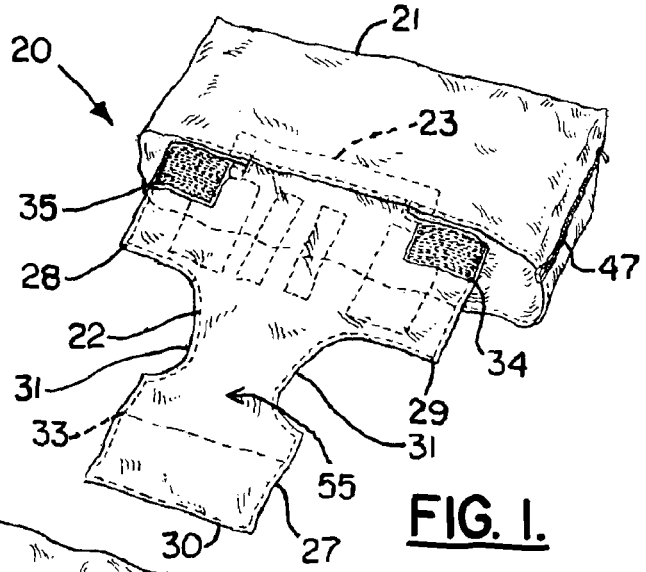
FIG. 1 is a partial perspective view of the preferred embodiment of the apparatus of the present invention.

FIGS. 1-11 show a preferred embodiment of the apparatus of the present invention, designated generally by the numeral 10 in FIGS. 4-7 and 11. The present invention provides an improved bedding article 10 for an infant or toddler having a base 11 in the form of a mattress. The base/mattress 11 has an upper surface 12, a pair of opposed side surfaces 13, 14. The side surfaces 13, 14 can be preferably generally triangularly shaped. Lower edge 15 is an edge formed by the intersection of upper surface 12 and a lower surface which is substantially flat and rectangular. The lower surface can be the same general size and shape as the upper surface 12, or of the same shape and slightly larger or slightly smaller than the upper surface 12. An upper end panel 16 can be generally rectangularly shaped and extends between the upper 12 and lower surfaces of the base/mattress 11 and in between the side surfaces 13, 14.

Figure 4:
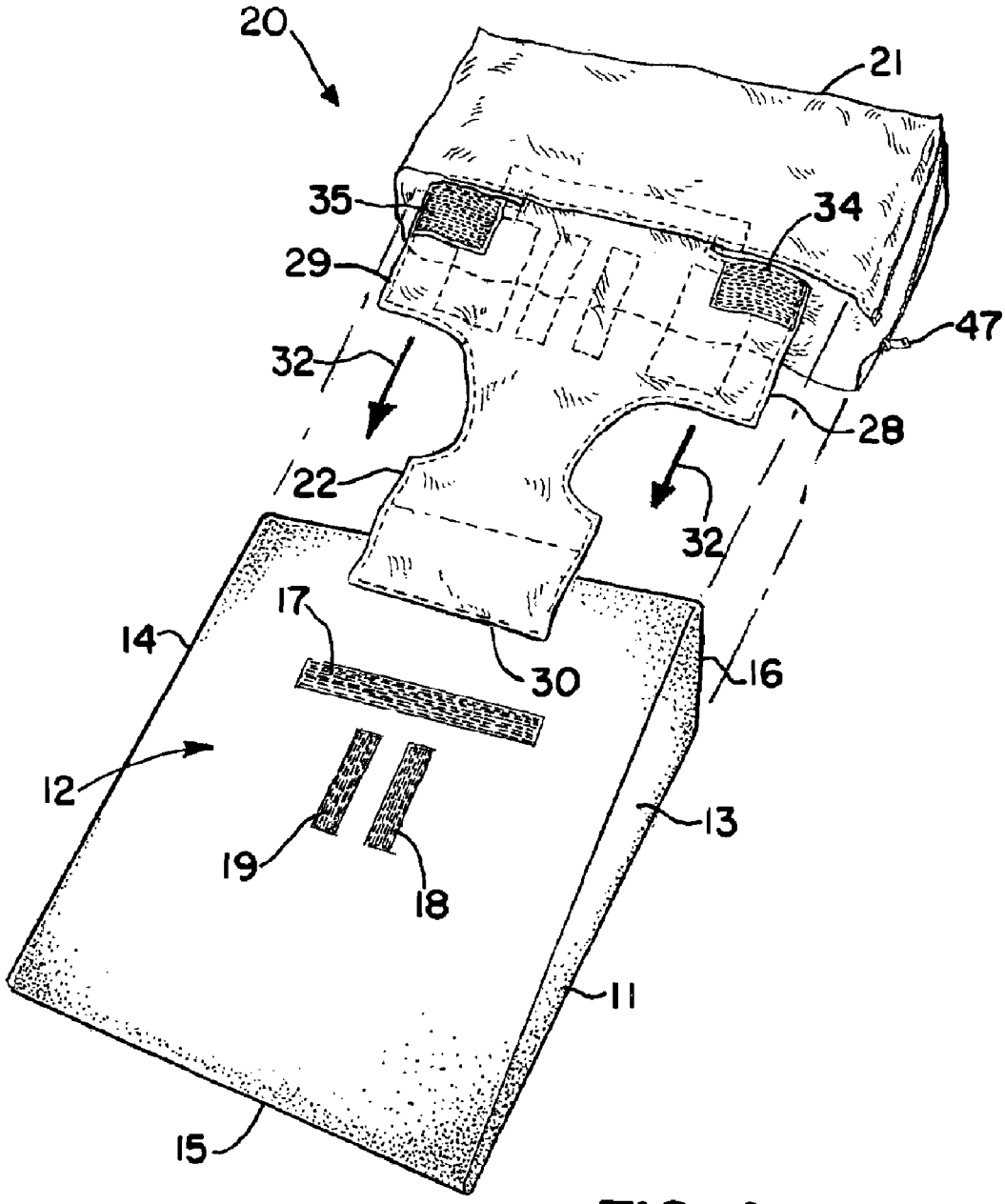
FIG. 4 is an exploded perspective view of the preferred embodiment of the apparatus of the present invention.
Figure 5:
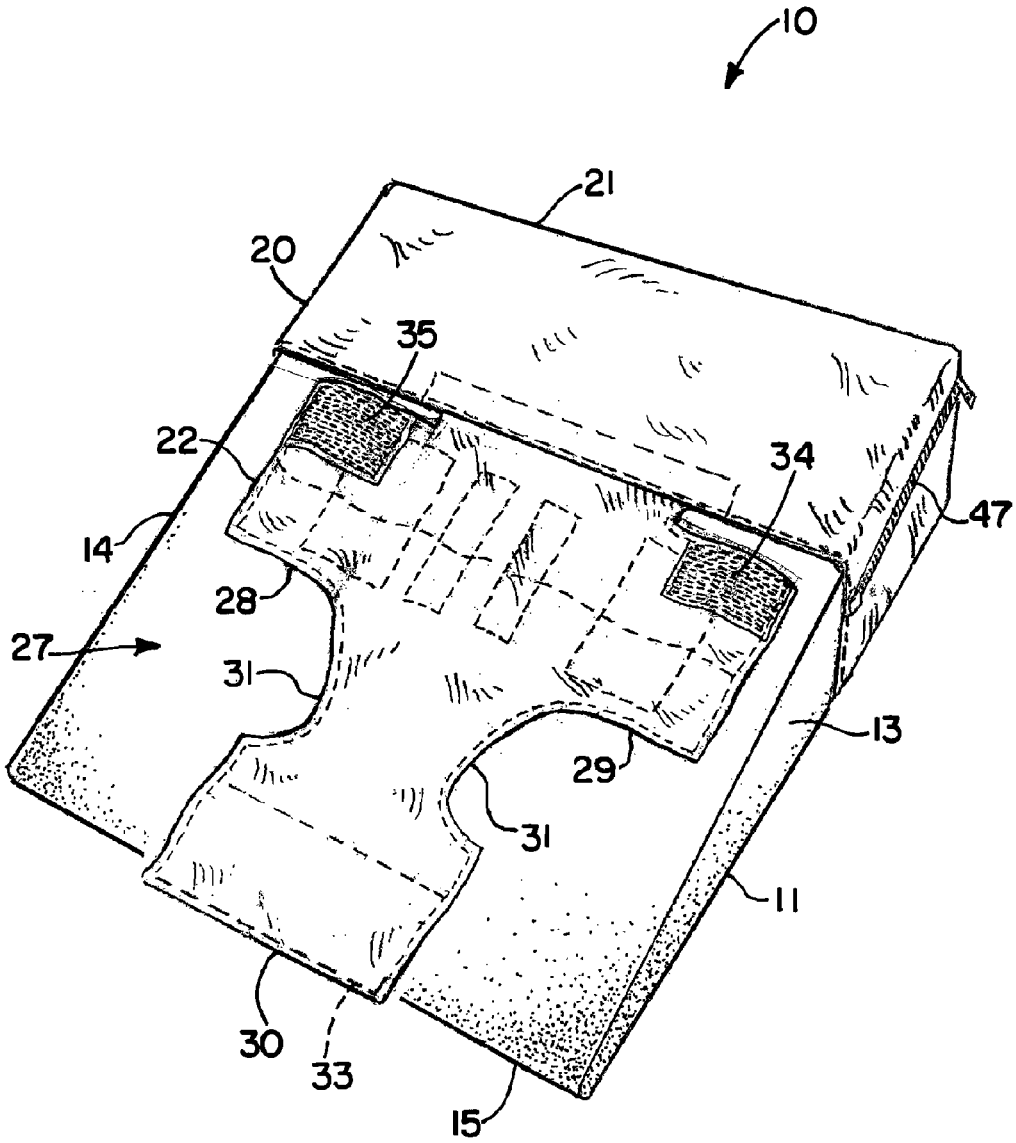
FIG. 5 is a perspective view of the preferred embodiment of the apparatus of the present invention showing the lower portion of the sling in an open position.
Figure 7:
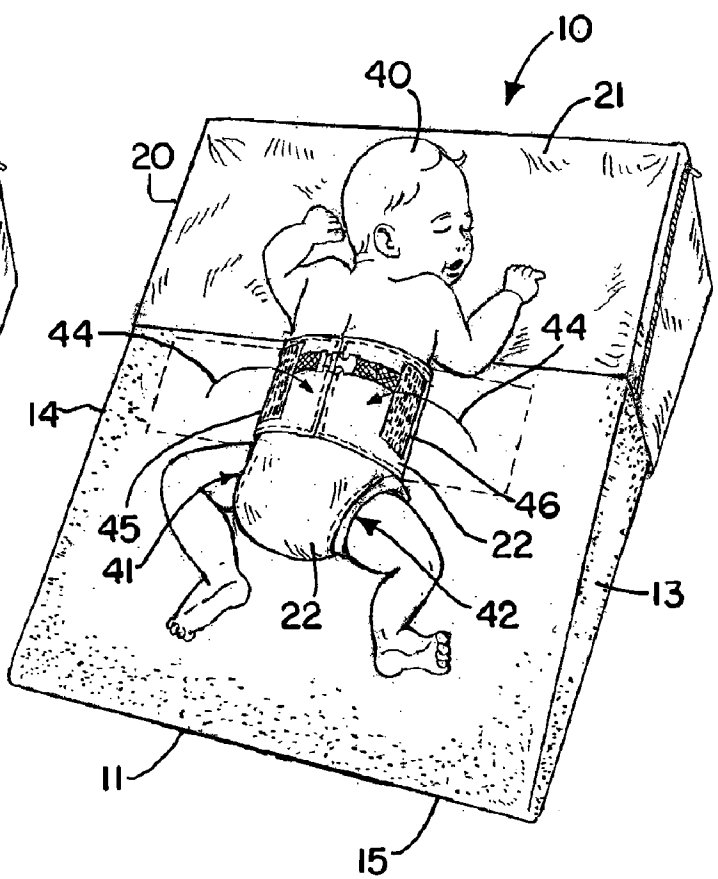
FIGS. 6 and 7 are sequential views illustrating an attachment of the lower part of the sling to an infant.
Figure 6:
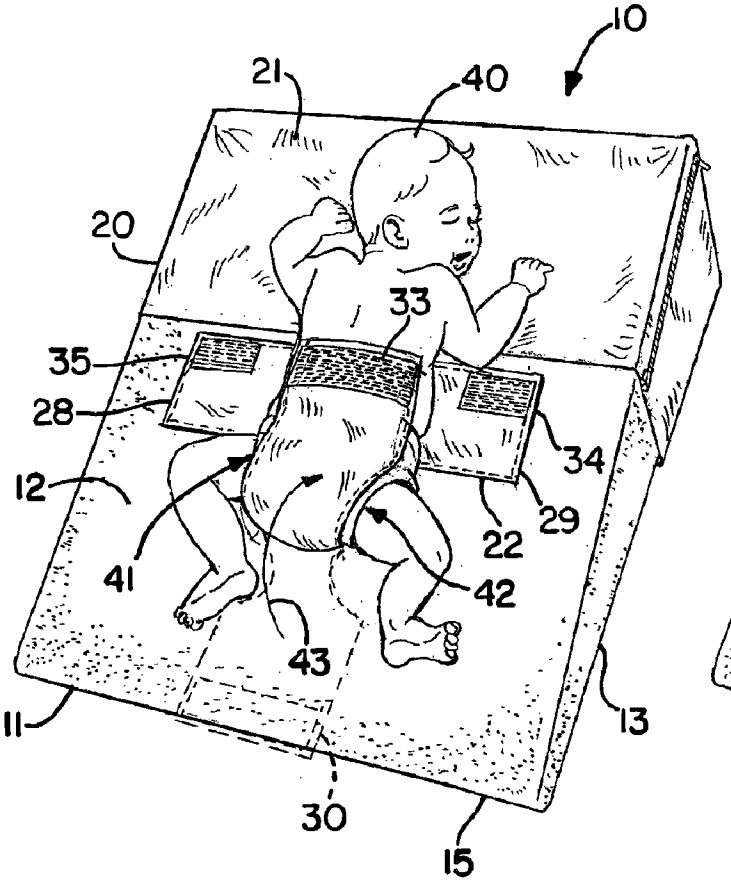
Figure 8:
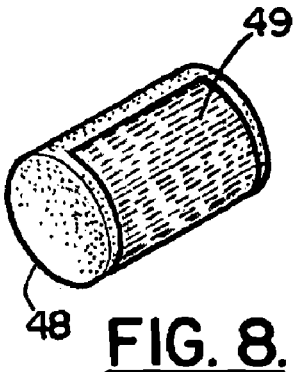
FIGS. 8, 9 and 10 are fragmentary perspective views of the block portions of the preferred embodiment of the apparatus of the present invention.
Figure 9:
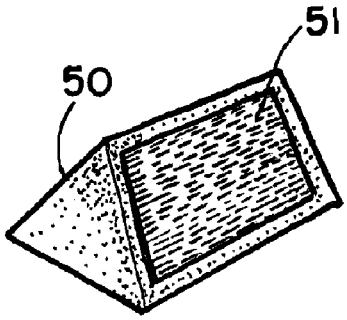
Figure 10:
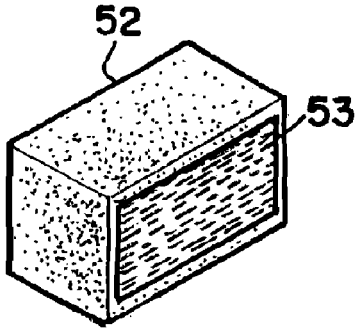

A sling 20 provides an upper sling section 21 and a lower sling section 22. Upper section 21 of sling 20 is sized and shaped to fit over the upper, elevated part of base/mattress 11 next to upper end panel 16 as indicated by arrows 32 in FIG. 4. FIGS. 5, 6, 7 show the connected position of upper section 21 of sling 20 to base or mattress 11. A zipper 47 can be provided on sling 20 upper section 21 to enable part of upper section to be opened as shown in FIG. 4, easing placement of upper section 21 on base/mattress 11.

The base/mattress 11 has a plurality of fastener strips 17, 18, 19 affixed to upper surface 12. The fastener strips 17, 18, 19 can be either the hook or the loop part of a hook and loop fastener such as Velcro®.

Sling 20 provides a plurality of strip fasteners 23, 24, 25 that correspond in size and shape to the fasteners 17, 18, 19 of the base/mattress 11. The fasteners 23, 24, 25 include a laterally extending fastener strip 23 that corresponds in size and shape to the laterally extending fastener strip 17. The fasteners 23, 24, 25 include a pair of longitudinally extending fastener strips 24, 25 that correspond respectively in size and shape to the longitudinally extending fastener strips 18, 19 on the upper surface 12 of base/mattress 11.

If the fastener strips 17, 18, 19 are hook strip fasteners, the corresponding fastener strips 23, 24, 25 would be loop fastener strips. However, the strips 17, 18, 19 could be loop type fastener strips in which case the fastener strips 23, 24, 25 would be hook type fastener strips. The laterally extending fastener strip 23 could be fastened to the lower end portion 26 of upper sling section 21.

Lower sling section 22 has a generally T-shaped section 27. The T-shaped section 27 includes left 28 and right 29 flaps as well as downwardly extending central flap 30. The central flap 30 can provide a small diameter or narrowed portion 31 (see FIG. 5).

Figure 2:
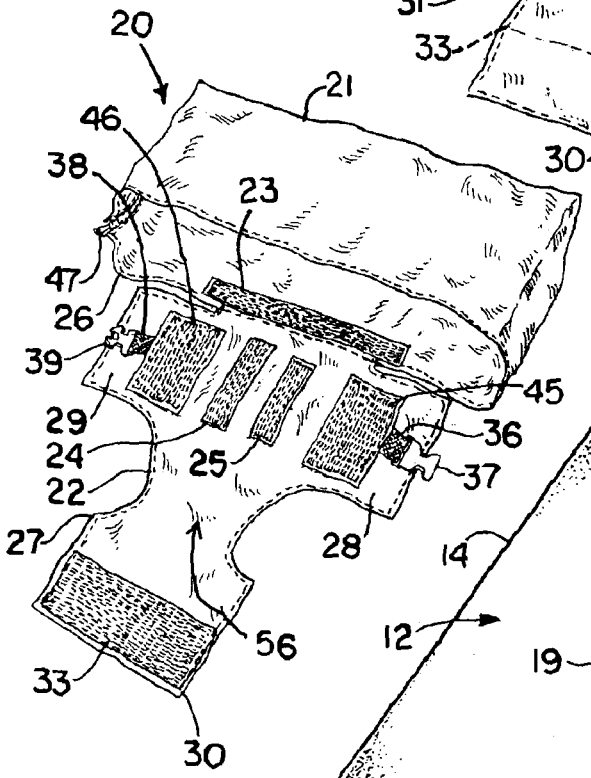
FIG. 2 is a partial perspective view of the preferred embodiment of the apparatus of the present invention.
Figure 3:
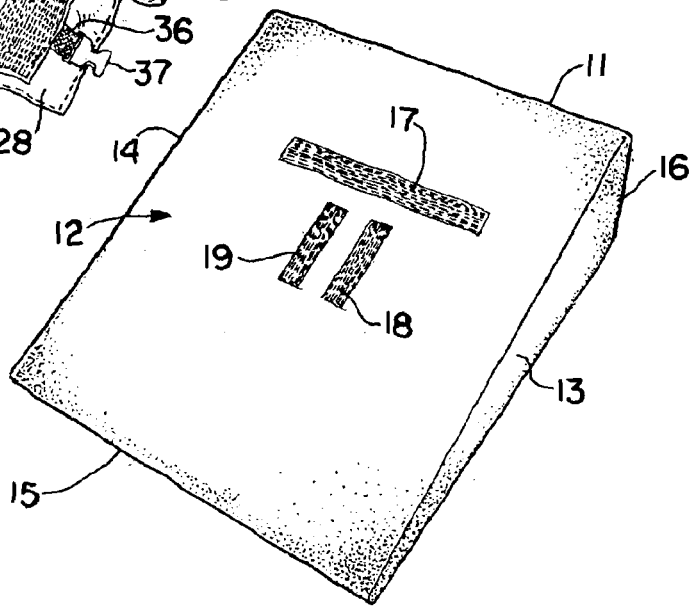
FIG. 3 is a partial perspective view of the preferred embodiment of the apparatus of the present invention.

Lower section 22 of sling 20 provides a plurality of fastener strips which enable a diaper shape (see FIGS. 6, 7 and 11) to be formed of lower section 22 around the pelvic area of infant or child 40. Laterally extending fastener strip 33 is carried by flap 30 as shown in FIG. 2. Fastener strips 34, 35 are provided on flaps 28, 29 respectively as shown in FIGS. 1 and 6. Fastener strips 34, 35 are on an opposite side of lower sling section 22 from the fastener strips 23, 24, 25. Thus, lower sling section 22 has upper surface 55 with fastener strips 34, 35 and lower surface 56 with fastener strips 24, 25, 45, 46 as shown in FIGS. 1-2, 4-5.

Figure 11:
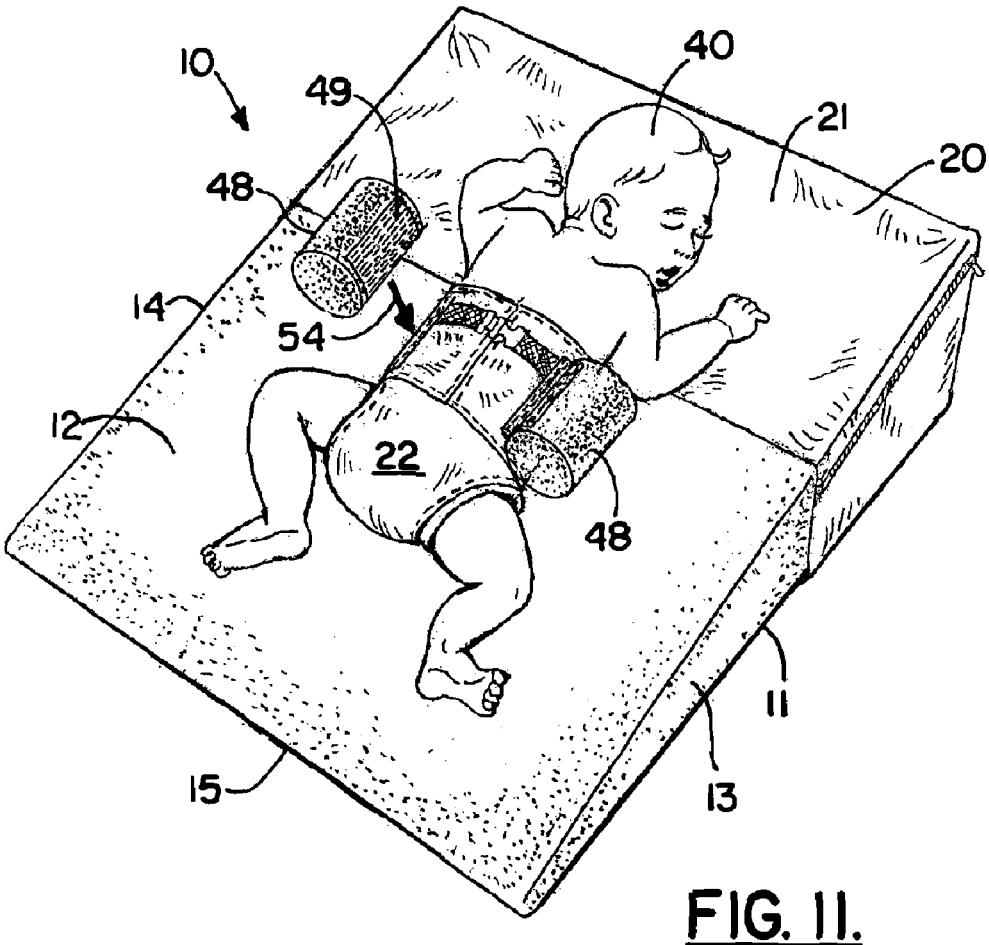
FIG. 11 is a perspective view of the preferred embodiment of the apparatus of the present invention.

Each of the flaps 28, 29 is provided with a belt section having a buckle part. Two of the buckle parts quickly connect and quickly disconnect. Such quick connect, quick disconnect buckles are commercially available. The flap 28 has belt section 36 and buckle part 37. The flap 29 has belt section 38 and buckle part 39. When the flaps 28, 29, 30 are assembled to form a diaper, openings 41, 42 are provided for the infant's legs as shown in FIGS. 6-7 and 11. Arrows 43 and 44 illustrate the assembly of flaps 28, 29, when forming a diaper for the infant or child 40. Arrow 43 illustrates the folding upwardly of flap 30 followed by a folding inwardly of the flaps 28, 29 as illustrated by arrows 44 in FIG. 7.

Each of the flaps 28, 29 has a fastener strip that connects to fastener strip 33 on flap 30. The flap 28 has fastener strip 34. The flap 29 has fastener strip 35. If the fastener strip 33 is a loop type fastener, the strips 34, 35 will be hook type fasteners to provide a hook and loop type connection such as Velcro®. The fastener strips 17, 18, 19 of FIG. 3 which are connected to fastener strips 23, 24, 25 respectively of FIG. 2 provide an anti-roll, anti-shifting connection between the sling 20 and the base/mattress 11. To provide an additional safety against rolling in a lateral direction, blocks (such as foam blocks or the like) are provided, each having a fastener strip that enables a connection to be formed between the block and the sling 20 at provided fastener strips 45, 46. The strips 45, 46 are seen in FIG. 7 prior to the application of a selected foam block.

The foam blocks shown in FIGS. 8-11 can include a foam block 48 having a generally cylindrically shaped cross section with fastener strip 49. Block 50 has a generally triangular cross section and a fastener strip 51. Block 52 has a generally rectangular cross section and a fastener strip 53. Any one of the blocks shown in FIGS. 8-10 can be attached to the sling 20 as illustrated by arrow 54 in FIG. 11. The fastener strips 49, 51, 53 can be loop type fastener strips wherein the fastener strips 45, 46 would be hook type fastener strips. However, the reverse could be used.

The following is a list of suitable parts and materials for the various elements of the preferred embodiment of the present invention.

PARTS LIST

| Parts Number | Description |
|---|---|
| 10 | infant/toddler sling bedding article |
| 11 | base/mattress |
| 12 | upper surface |
| 13 | side surface |
| 14 | side surface |
| 15 | lower edge |
| 16 | upper end panel |
| 17 | laterally extending fastener strip |
| 18 | longitudinally extending fastener strip |
| 19 | longitudinally extending fastener strip |
| 20 | sling |
| 21 | upper sling section |
| 22 | lower sling section |
| 23 | laterally extending fastener strip |
| 24 | longitudinally extending fastener strip |
| 25 | longitudinally extending fastener strip |
| 26 | lower end portion |
| 27 | T-shaped section |
| 28 | flap |
| 29 | flap |
| 30 | flap |
| 31 | narrowed portion |
| 32 | arrow |
| 33 | laterally extending fastener strip |
| 34 | fastener strip |
| 35 | fastener strip |
| 36 | belt section |
| 37 | buckle part |
| 38 | belt section |
| 39 | buckle part |
| 40 | infant/small child/toddler |
| 41 | opening |
| 42 | opening |
| 43 | arrow |
| 44 | arrow |
| 45 | fastener strip |
| 46 | fastener strip |
| 47 | zipper |
| 48 | block |
| 49 | fastener strip |
| 50 | block |
| 51 | fastener strip |
| 52 | block |
| 53 | fastener strip |
| 54 | arrow |
| 55 | upper surface |
| 56 | lower surface |

The foregoing embodiments are presented by way of example only; the scope of the present invention is to be limited only by the following claims.

The invention claimed is:

1. A bedding article for supporting reflux babies, comprising:

(a) a base mattress having an inclined upper surface;

(b) an infant support sling that includes an upper section defining a whole or partial covering for the mattress and forming a tensile load carrying connection therewith, the upper section having a lower end portion positioned during use at the middle area of the mattress;

(c) a diaper secured to the support sling, the diaper defined by a central panel portion, a left panel portion, and a right panel portion that can connect to define a band that encircles the infant's torso, wherein the diaper is configured to cover the infant's groin, at least part of the infant's torso, and the pelvic area, the diaper having leg apertures accommodating the infant's legs, the leg apertures being pointed generally away from the tensile load carrying connection so that when the mattress is inclined, the diaper supports the infant and carries the infant's weight to prevent a sliding of the infant down the mattress during use;

(d) a plurality of connector strips that connect and hold the sling to the mattress, the strips including at least two strips that are longitudinally spaced and at least two strips that are transversely spaced apart;

(e) one or more blocks that are removably attachable to the diaper at a position above the mattress, each block simultaneously engaging the mattress to prevent a lateral rolling of the sling and infant relative to the mattress; and (f) wherein there is a block connection that connects each of the blocks to the diaper at a position above the base mattress, each block connection extending from the upper edge of the diaper downwardly to a position on the diaper next to said leg opening.

2. The bedding article of claim 1, wherein the panels each carry fasteners for connecting a panel to another panel.

3. The bedding article of claim 1, wherein the central panel portion is generally T-shaped.

4. The bedding article of claim 1, wherein each side panel has means for forming a connection with the central panel portion that defines a diaper shape upon assembly.

5. The bedding article of claim 4, wherein the diaper size can be adjustably varied to fit infants of different sizes.

6. A bedding article for supporting reflux babies, comprising:

(a) a base mattress having an inclined upper surface;

(b) an infant support sling that includes upper and lower sections, the upper section defining a partial covering for the base mattress and forming a tensile load carrying connection therewith, a band having a lower end portion positioned during use at the middle area of the mattress, the lower section connected to the upper section;

(c) the sling including a diaper that includes a central panel portion, a left panel portion, and a right panel portion that connect to define said diaper that covers the infant's groin and pelvic area, with leg apertures accommodating the infant's legs, the leg apertures being pointed generally away from the tensile load carrying connection so that when the mattress is inclined, the diaper supports the infant and the band carries the infant's weight to prevent a sliding of the infant down the mattress during use, the diaper having upper and lower end portions;

(d) wherein the upper section includes an endless band that encircles the mattress, a first closed end covering the upper end of the mattress, and a second open lower end;

(e) a plurality of connector strips that connect and hold the sling to the mattress, the strips including at least two strips that are longitudinally spaced and at least two strips that are transversely spaced apart;

(f) one or more blocks that are removably attachable to the diaper with block connections that are positioned above the mattress, the blocks simultaneously engaging the mattress to prevent a lateral rolling of the sling and infant relative to the mattress; and (g) wherein each of the blocks extends from the upper edge portion of the diaper downwardly to a position next to said leg opening.

7. A bedding article for supporting a reflux infant, comprising:

(a) a base mattress having an inclined upper surface;

(b) an infant support sling that includes an upper section defining an at least partial covering for the mattress, the upper section having a lower end portion positioned during use at the middle area of the mattress and a central panel portion, a left panel portion, and a right panel portion that can connect to define a diaper that covers the infant's groin, pelvic area, and a least part of the infant's torso, and providing leg apertures accommodating the infant's legs, the leg apertures being pointed generally away from a tensile load carrying connection so that when the mattress is inclined, the diaper supports the infant and carries the infant's weight to prevent a sliding of the infant down the mattress during use the diaper having a top portion and a bottom portion;

(c) one or more detachable connector strips that removably connect and hold the sling to the mattress; and (d) blocks that are each connectable to the diaper on opposing sides of the diaper with block connectors, each block extending upwardly from the inclined upper surface of the base mattress and connecting to the diaper with the block connectors at a position above the base mattress; and (e) the blocks each extending along the diaper from a position next to the leg opening upwardly to a position next to the top portion of the diaper.

8. The bedding article of claim 7, wherein each of the panels each carry fasteners for connecting a panel to another panel.

9. The bedding article of claim 7, wherein the central panel portion is generally T-shaped.

10. The bedding article of claim 7, wherein each side panel has means for forming a connection with the central panel portion that enables formation of the sling into a diaper shape.

11. The bedding article of claim 7, wherein the blocks have a triangular cross section.

12. The bedding article of claim 7 wherein the blocks engage the mattress next to the sling to prevent a lateral rolling of the sling and infant relative to the mattress.

13. The bedding article of claim 7 wherein the blocks each have a circular cross section.

14. The bedding article of claim 7 wherein each block removably attaches to the base mattress.

15. A bedding article for supporting reflux babies, comprising:

(a) a base mattress having an inclined upper surface;

(b) an infant support sling that includes upper and lower sections, the upper section defining a partial covering for the base mattress and forming a tensile load carrying connection therewith, a band having a lower end portion positioned during use at the middle area of the mattress, the lower section connected to the upper section and including a central panel portion, a left panel portion, and a right panel portion that can connect to define a diaper that covers the infant's pelvic area and at least part of the infant's torso, with leg apertures accommodating the infant's legs, the leg apertures being pointed generally away from the tensile load carrying connection so that when the mattress is inclined, the diaper supports the infant and the band carries the infant's weight to prevent a sliding of the infant down the mattress during use, the diaper having upper and lower end portions;

(c) wherein the upper section includes an endless band that encircles the mattress, a first closed end covering the upper end of the mattress, and a second open lower end;

(d) one or more detachable connections that connect and hold the sling to the mattress;

(e) a pair of blocks that are attached to the diaper on opposing sides of the diaper;

(f) the blocks connected to the diaper with block connectors that extend along the diaper from a position next to the leg opening upwardly to a position next to the upper end portion of the diaper; and (g) the block connectors spaced above the base mattress.

16. The bedding article of claim 15, wherein the blocks each have a triangular cross section.

17. The bedding article of claim 15 wherein each block has a cylindrical shape.

18. The bedding article of claim 15 wherein each block has a generally rectangular cross section.

19. The bedding article of claim 15 wherein the connections are placed in between the blocks and in between the sling and base mattress.

* * * * *